US005105967A

United States Patent [19]

Horpestad

[11] Patent Number: 5,105,967

[45] Date of Patent: Apr. 21, 1992

[54] WASTE CONTAINER LID SYSTEM

[76] Inventor: Melvin V. Horpestad, 3521 River Road West, R.R. No. 1, Delta, British Columbia, Canada, V4K 3N2

[21] Appl. No.: 677,200

[22] Filed: Mar. 29, 1991

[51] Int. Cl.[5] ..... B65D 43/14

[52] U.S. Cl. ..... 220/333; 220/331; 220/908

[58] Field of Search ..... 220/315, 334, 342, 343, 220/908, 331, 333

[56] References Cited

U.S. PATENT DOCUMENTS

| | | | |
|---|---|---|---|
| 2,435,670 | 2/1948 | Buehler | 220/333 |
| 3,989,162 | 11/1976 | Hodge et al. | 220/331 |
| 3,994,415 | 11/1976 | Hodge | 220/331 |
| 4,014,457 | 3/1977 | Hodge | 220/331 |
| 4,186,844 | 2/1980 | Swanson | 220/333 |

*Primary Examiner*—Stephen Marcus
*Assistant Examiner*—Nova Stucker
*Attorney, Agent, or Firm*—Robbins, Dalgarn, Berliner & Carson

[57] ABSTRACT

Existing dumpster lids are difficult for a user to lift and also leak some water into the container. The lids also tend to become bent when dumping into a full garbage truck, as the lid presses against the mound of trash. The present invention provides a waste container and lid assembly comprising a lid having a pivot arm which operates on a pivoting surface attached to the side of the container and having a fulcrum. The pivot arm has first, second and third pivot points on its lower surface in order to move the pivot point as the center of gravity of the lid shifts during opening to keep the center of gravity approximately over the pivot point. The lid is connected to the container by a two-piece hinge which swings the pivot arm clear of the supporting plates when the container is inverted. This allows the lid to swing freely on the two-part hinge which also permits the lid to move up or down while hanging in order to avoid damage to the lid if a solid mass is struck. The lid when closed is also able to slide forward to permit automatic unlocking.

11 Claims, 5 Drawing Sheets

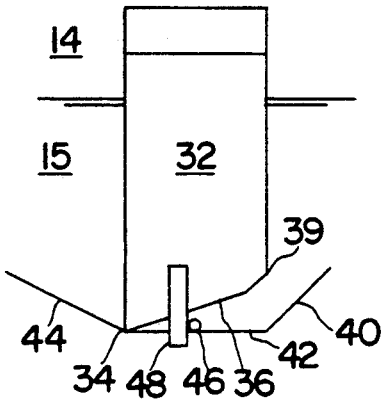
FIG.4A
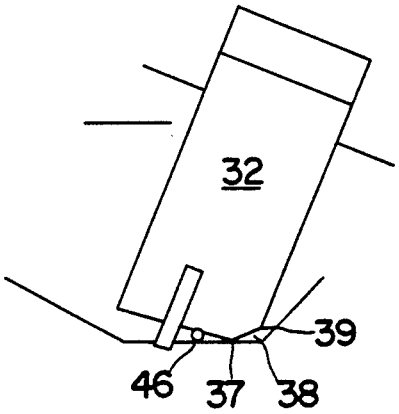
FIG.4B
FIG.4C
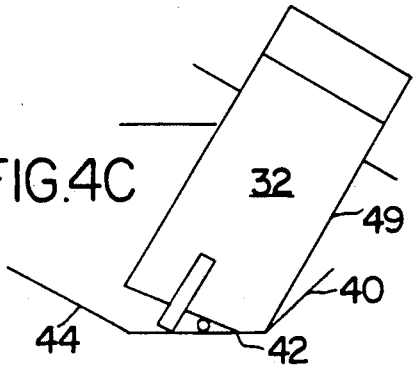
FIG.4D
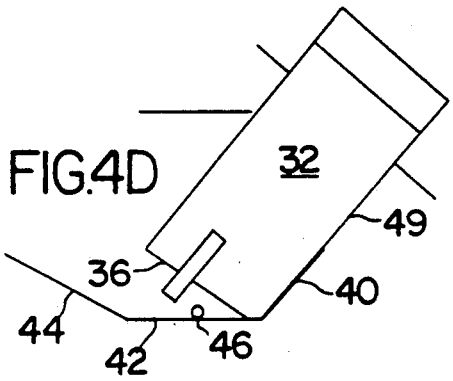
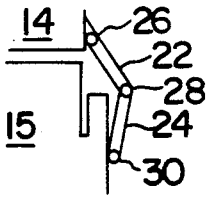
FIG.5A
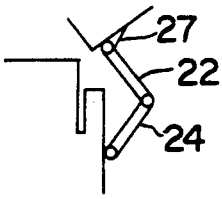
FIG.5B
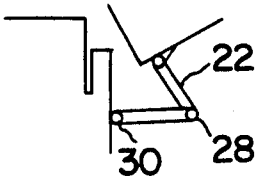
FIG.5C
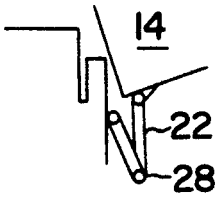
FIG.5D

WASTE CONTAINER LID SYSTEM

FIELD OF THE INVENTION

The invention relates to commercial and industrial waste containers or "dumpsters" designed for emptying into a waste removal truck by mechanical means. More particularly it relates to improvements in the lids for dumpsters.

BACKGROUND OF THE INVENTION

Waste from businesses and industries is generally stored in large, wheeled metal bins referred to as "dumpsters" which are designed to be emptied mechanically by specially equipped garbage trucks having hydraulically-operated lifting arms or forks which engage, lift and tip the dumpster. It is important that water be kept out of such containers, since users pay for removal by weight. To avoid becoming filled with rainwater, a lid must be provided for the dumpster which is hinged to permit filling and emptying of the dumpster. Such lids are metal and are generally formed in two parts due to the large weight of such lids. Even so, such lids are difficult for a user to lift and also leak some water into the container. The lids also tend to become bent when dumping into a full garbage truck, as the lid presses against the mound of trash. Such bending adds to the leakage problem in the container.

It is also useful to be able to lock the dumpster lid, to avoid unauthorized persons placing waste in the dumpster. It is preferable that the driver of the garbage truck need not have a key for the lock, nor have to descend from the truck in order to unlock the lid.

Various systems have been proposed for rendering dumpster lids easier to open. For example Hodge U.S. Pat. Nos. 3,989,162; 4,014,457; 4,098,429; 4,148,411 and Re. 30,890 disclose a lid system in which rollers or sliders assist the initial partial opening of the lid, while a pivot arm allows the lid to hang freely when dumping. In other variants of the Hodge design, stops on the inner surface of the lid hold the lid in a partially opened position. Such designs require counter-weights on the lid, and rollers tend to malfunction under the rigorous conditions under which dumpsters are used. U.S. Pat. No. 4,609,117 also discloses a lid assembly in which a curved lid is assisted in partially opening by counterweight springs, and which swings freely when inverted

SUMMARY OF THE INVENTION

The present invention provides a waste container and lid assembly comprising a lid having a pivot arm which operates on a pivoting surface attached to the side of the container and having a fulcrum. The pivot arm has first, second and third pivot points on its lower surface in order to move the pivot point as the centre of gravity of the lid shifts during opening to keep the centre of gravity approximately over the pivot point. The lid is connected to the container by a two piece hinge which swings free when the container is inverted. The lid is able to slide forward to permit automatic unlocking.

BRIEF DESCRIPTION OF THE DRAWINGS

In drawings which illustrate a preferred embodiment of the invention:

FIG. 4A through 4D are partial side elevational views of the pivot arm of the invention in successive opening positions;

FIG. 5A through 5D are partial side views of the lid hinge of the invention in the successive lid positions illustrated in FIG. 4.

DETAILED DESCRIPTION OF THE PREFERRED EMBODIMENT

Figure 1:
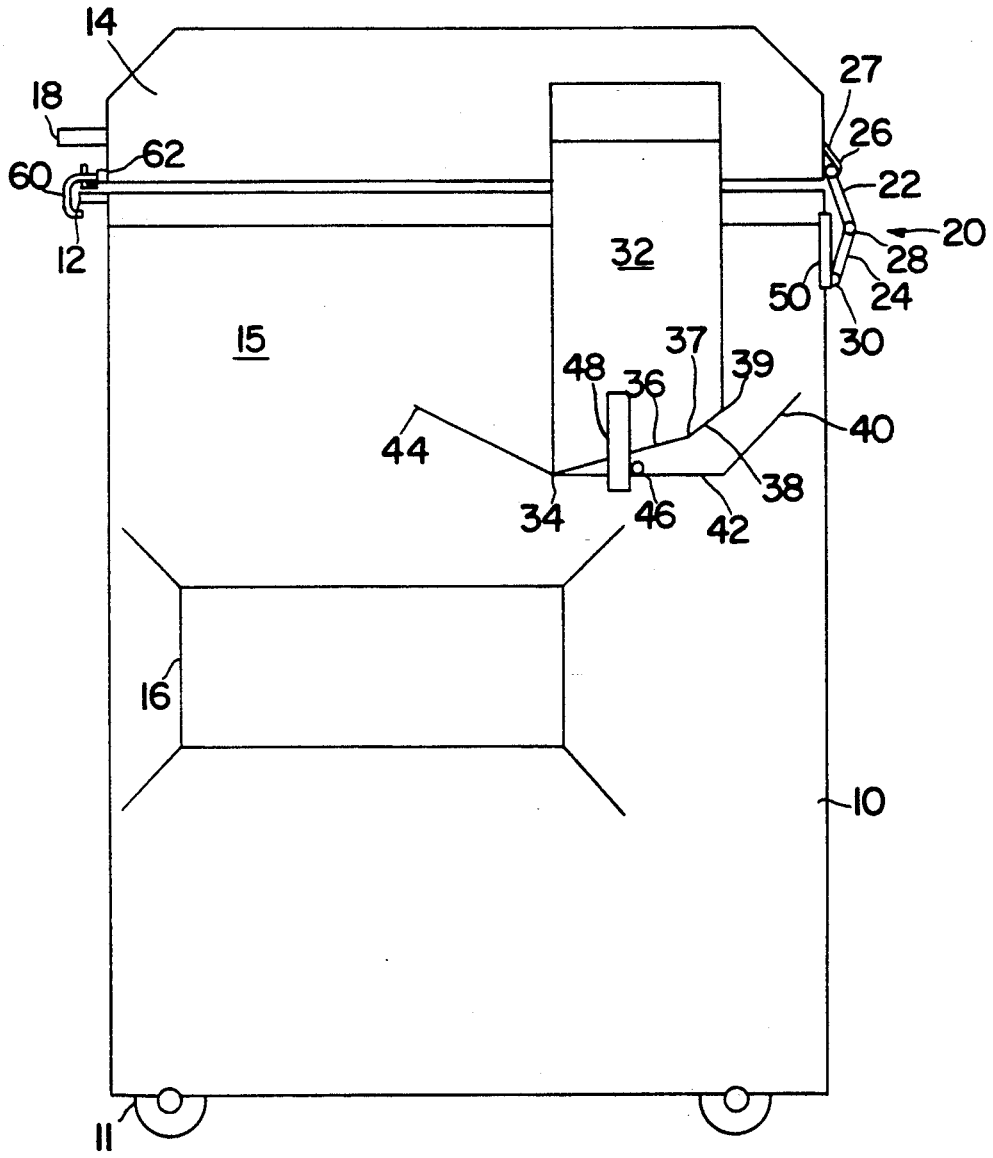
FIG. 1 is a side elevational view of the invention in a closed position.

With reference to FIG. 1, a waste container 10 has wheels 11 (which are optional), an upper edge 12 and a lid 14. Side 15 of the container 10 is shown, although both sides are identical. Hollow rectangular pocket 16 is welded to side 15 and receives the forks of a fork lift garbage truck for lifting, inverting and emptying the container. Lid 14 has two handles 18 attached to its front edge. Lid 14 is attached along its rear edge to the container 10 by a two part hinge 20 consisting of a central hinge 28, upper hinge 26, and lower hinge 30. Upper hinge 26 is fixed to the container by welding at bands 27. Plates 22 pivot on hinge 26 and are fixed to the central hinge 28. An elongated plate 24 pivots on hinge 28 at its upper edge and on hinge 30 at its lower edge. Hinge 30 is secured also to the container 10.

Extending perpendicularly about 3 inches from each side 15 of the container 10 are three metal plates 40, 42, 44. Plate 42 is substantially horizontal and has welded across the midpoint of its upper surface, in a direction perpendicular to the side 15 of the container, a cylindrical metal dowel which acts as a fulcrum in a manner described below. A substantially rectangular pivot arm 32, also about three inches deep is welded to each side of lid 14. A metal bar 48 is welded to its side to guide the pivot arm on plates 40, 42, 44.

The bottom surface of pivot arm 32 consists of a first pivot point 34, first flat surface 36, second pivot point 37, second surface 38 and third pivot point 39. In operation, as shown in FIG. 4, when the lid is closed the weight of the lid rests on point 34. As the front of the lid is raised, surface 36 rotates on fulcrum 46 until point makes contact with plate 42. At that point the arm pivots on point 37 and surface 36 is lifted off fulcrum 46. As the lid opens further, surface 38 comes to rest on surface 42, and the lid rests in that position with some stability. Finally, as the lid continues to be opened, the pivot arm pivots on point 39 until surface 49 of the pivot arm rests against plate 40. In this way, as the centre of gravity of the lid is shifted to the right in FIG. 4, the pivot point is also shifted to the right, so that the centre of gravity is always approximately over the pivot point, making the lid relatively easy to open while providing a series of stable resting places as the lid is opened. The present invention thus permits the lid to be constructed of very heavy material, yet the lid remains relatively easy to open and close.

Figure 6:
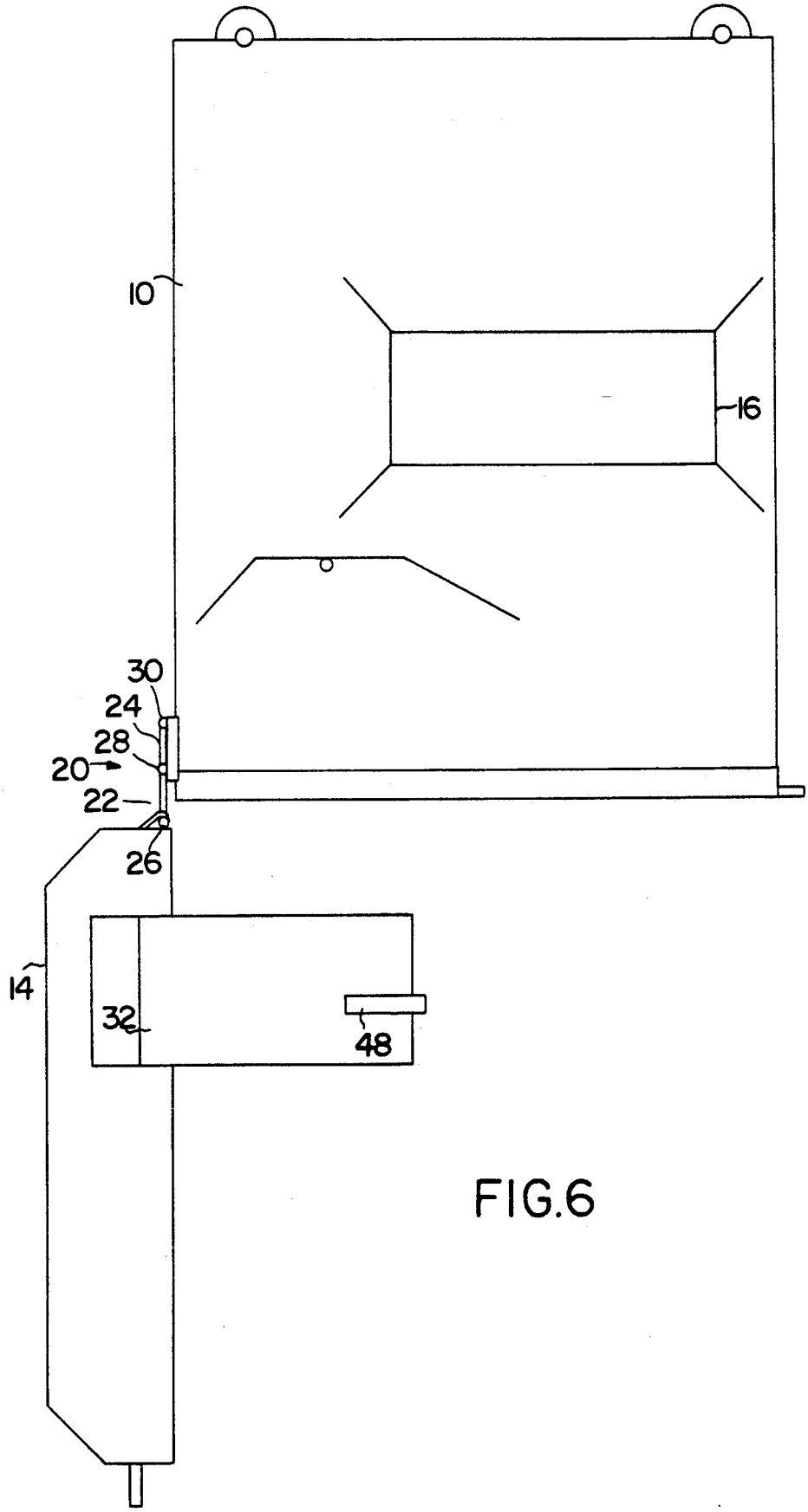
FIG. 6 illustrates the invention in the inverted position for dumping.

With reference to FIG. 5, the hinge of the invention is formed of two plates which jack-knife together as the lid is opened completely. However, when the container is inverted for dumping, as shown in FIG. 6, the lid will hang freely between the two ends 26 and 30 of the hinge. This also permits the lid to move up or down or laterally away from the container if it should encounter an obstacle, such as a mound of garbage, in the process of being dumped. When the container 10 is brought back to its upright position, point 34 strikes plate 44 which, along with bar 48, guides point 34 back into the position shown in FIG. 1.

Figure 2:
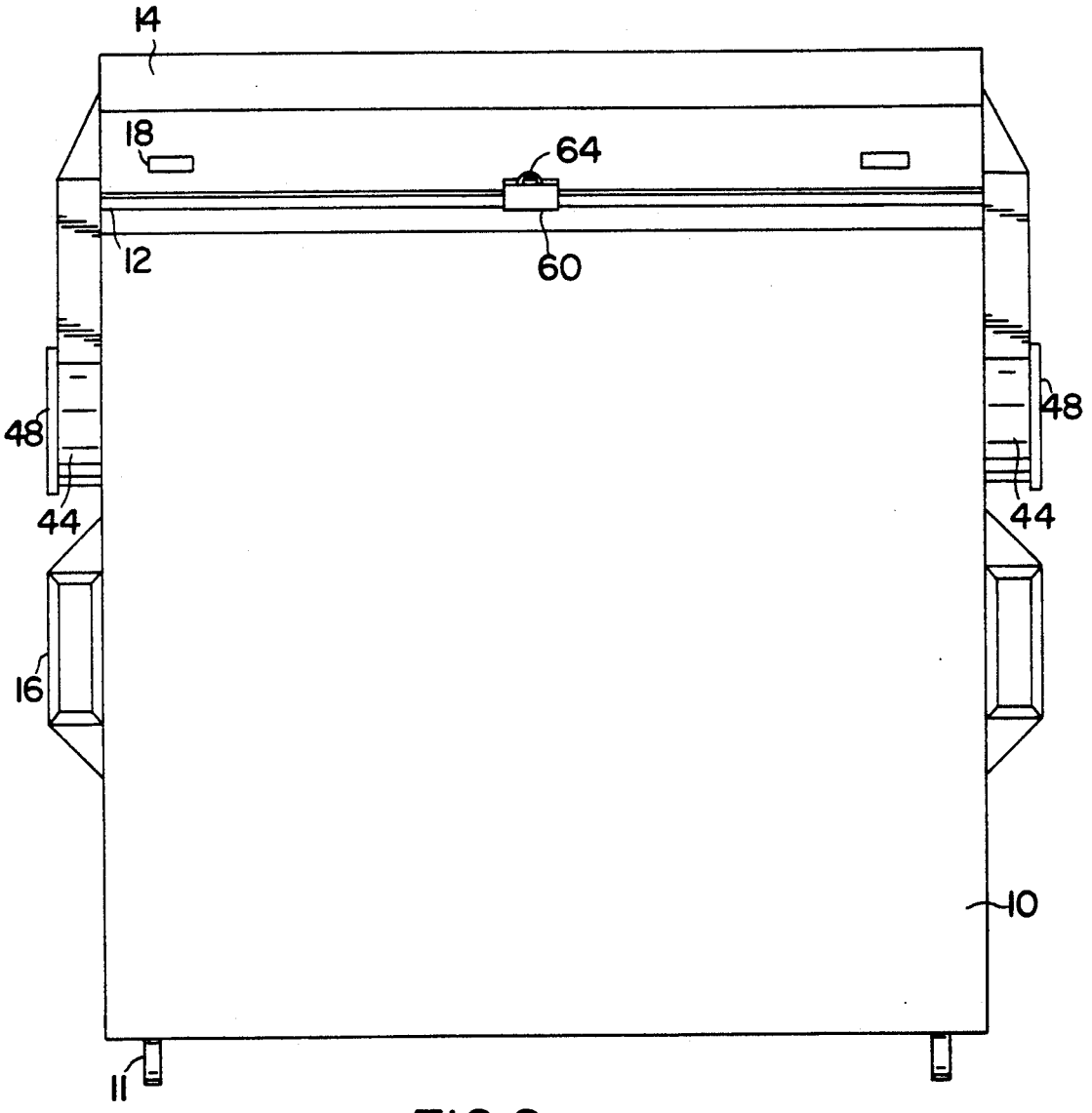
FIG. 2 is a front view of the invention in a closed position.
Figure 3:
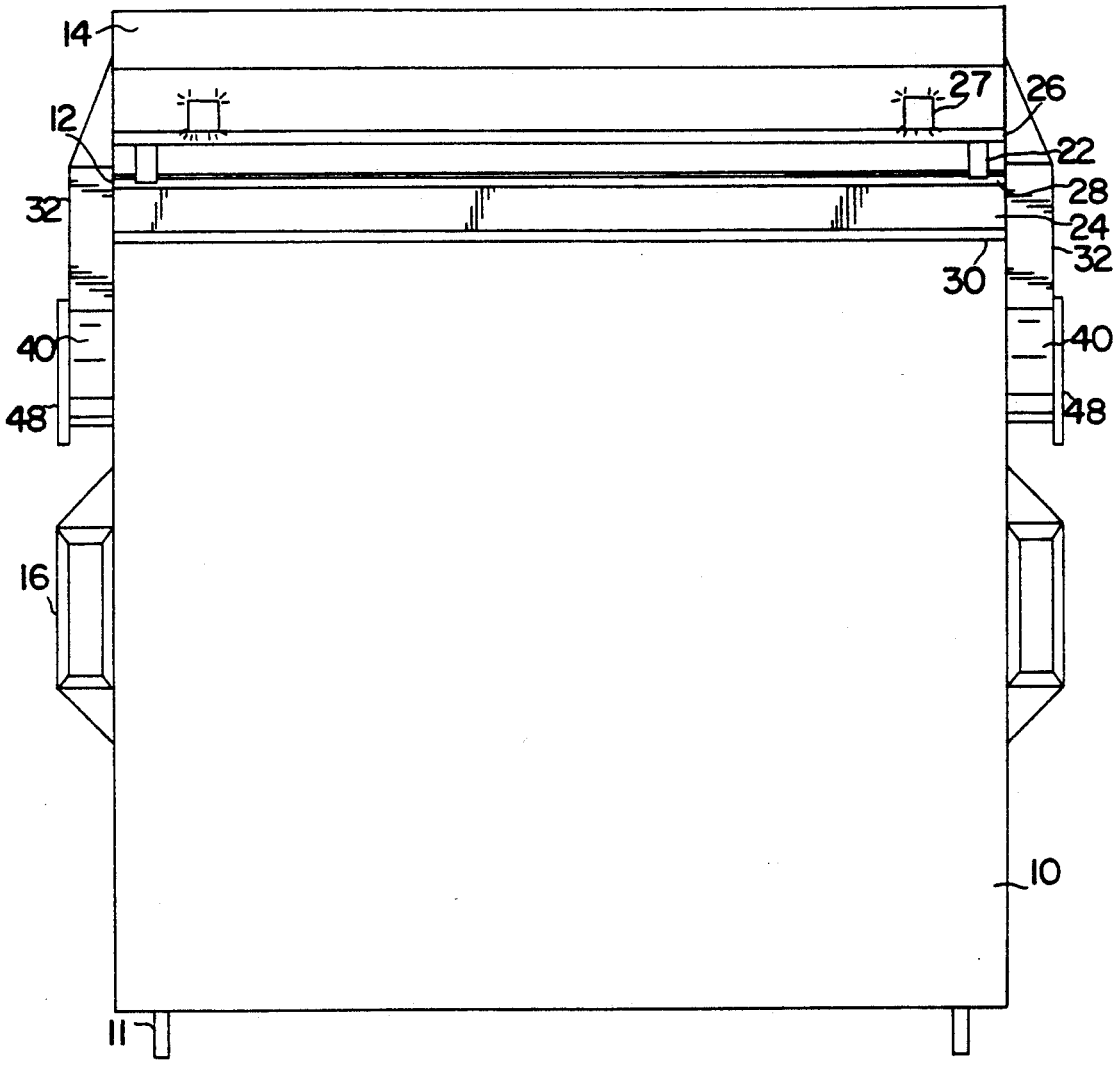
FIG. 3 is a rear view of the invention in a closed position.

When the lid is in the closed position shown in FIG. 5A, there is the possibility of the lid moving forward about 1.5. inches due to the position of extension 50 on which hinge 30 is mounted. Due to the weight of the lid, however, an individual could not move it while in the closed position. Thus a locking system can be provided in which a clasp, for example, can be locked over a protrusion on the front edge of the container, preventing lifting of the lid, but which comes free when the dumpster is lifted and tilted forward by the emptying truck. As shown schematically in FIGS. 1 and 2, a hooked clasp 60 can be provided which is hinged at 62 and has an opening for ring 64 which can accept a lock (not shown) to secure it in the lower position. The clasp 60 thus can be removed only by removing the lock or allowing the lid 14 to slide forward enough that clasp 6 clears edge 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A waste container and lid assembly comprising:

a) a hollow container having a closed bottom, an open top and vertically extending front, back and side walls defining an upper edge around said open top;

b) an upwardly facing pivot surface attached to each of said side walls of said container each said pivot surface having a transverse centrally located fulcrum means;

c) a lid having front and back edges and right and left sides, said lid being hingedly connected to said upper edge of said container along said back edge of said lid and comprising a pivot arm on each side of said right and left sides thereof each said pivot arm having a lower surface and a plurality of pivot points arranged consecutively from front and back on said lower surface whereby lifting of said lid causes each said pivot arm to pivot on each of said pivot points in succession from front and back.

2. The waste container and lid assembly of claim 1 wherein each said pivot surface comprises a transversely oriented fulcrum adapted to bear against said lower surface of each one of said pivot arms.

3. The waste container and lid assembly of claim 1 wherein each of said lower surfaces comprises first, second and third pivot points.

4. The waste container and lid assembly of claim 3 wherein each of said lower surfaces of each of said pivot arms comprises a first surface between said first and second pivot points for bearing against said fulcrum.

5. The waste container and lid assembly of claim 4 wherein each of said lower surfaces of each of said pivot arms comprises a second surface between said second and third pivot points for resting on said pivot surfaces.

6. The waste container and lid assembly of claim 1 wherein each of said pivot arms comprises a rearwardly facing edge, and further comprising rearwardly extending surfaces joining each of said pivot surfaces at an acute angle against which each of said rearward edges of said pivot arms bears when said lid is opened to its maximum extent.

7. The waste container and lid assembly of claim 6 further comprising frontwardly extending surfaces joining each of said pivot surfaces at an acute angle which surfaces contact said lower surfaces of said pivot arms when said lid is returned from an inverted dumping position.

8. The waste container and lid assembly of claim 1 wherein each of said pivot arms further comprises guide bar means secured to the side of each of said pivot arms and extending below the edge of each of said pivot surfaces when said lid is in a closed position.

9. The waste container and lid assembly of claim 1 wherein said hinged connection of said lid comprises a two-part hinge having a first hinge pivotally connected to the rear edge of said lid, a second hinge pivotally connected to said rear edge of said container, and a third central hinge pivotally connected to said first and second hinges.

10. The waste container and lid assembly of claim 1 wherein said lid is adapted to move forward on said upper edge of said container when said lid is in a closed position.

11. The waste container and lid assembly of claim 10 further comprising locking means attached to said lid for engaging said upper edge of said container and which thereby enables locking of said lid in a closed position when said lid is in its normal position but which disengages said lid from said upper edge when said lid is moved forward to permit the emptying of said container.

* * * * *